US007355110B2

(12) United States Patent
Nash

(10) Patent No.: US 7,355,110 B2
(45) Date of Patent: Apr. 8, 2008

(54) STRINGED MUSICAL INSTRUMENT HAVING A BUILT IN HAND-HELD TYPE COMPUTER

(76) Inventor: Michael Tepoe Nash, 5417 Walnut Rd., Baxter, TN (US) 38544

( * ) Notice: Subject to any disclaimer, the term of this patent is extended or adjusted under 35 U.S.C. 154(b) by 0 days.

(21) Appl. No.: 10/786,343

(22) Filed: Feb. 25, 2004

(65) Prior Publication Data

US 2005/0183566 A1 Aug. 25, 2005

(51) Int. Cl.
*G10H 1/00* (2006.01)
*G10H 7/00* (2006.01)

(52) U.S. Cl. ..... 84/601; 84/267; 84/454; 84/477 R; 84/485 R; 84/646

(58) Field of Classification Search ..... 84/601, 84/477 R, 455, 464 A, 453, 462, 485 R, 84/314 R, 454, 464 R, 267, 646
See application file for complete search history.

(56) References Cited

U.S. PATENT DOCUMENTS 4,080,867 A * 3/1978 Ratanangsu ..... 84/477 R
4,286,495 A * 9/1981 Roof ..... 84/485 R
4,297,938 A * 11/1981 Kirby ..... 84/455
4,318,327 A * 3/1982 Toups ..... 84/477 R
4,378,720 A * 4/1983 Nakada et al. ..... 84/611
4,658,690 A * 4/1987 Aitken et al. ..... 84/629
4,791,848 A * 12/1988 Blum, Jr. ..... 84/453
4,794,838 A * 1/1989 Corrigau, III ..... 84/600
4,858,509 A * 8/1989 Marshall ..... 84/646
4,915,005 A * 4/1990 Shaffer et al. ..... 84/314 R
4,919,031 A * 4/1990 Matsumoto ..... 84/601
5,038,662 A * 8/1991 Ho ..... 84/723
5,040,447 A * 8/1991 Murata et al. ..... 84/612
5,266,735 A * 11/1993 Shaffer et al. ..... 84/609
5,270,475 A * 12/1993 Weiss et al. ..... 84/603
5,408,914 A * 4/1995 Breitweiser et al. ..... 84/477 R
5,442,986 A * 8/1995 Cota ..... 84/267
5,637,820 A * 6/1997 Wittman ..... 84/454
5,837,912 A * 11/1998 Eagen ..... 84/267
5,877,444 A * 3/1999 Hine et al. ..... 84/454
5,889,221 A * 3/1999 Dejima ..... 84/291
5,936,179 A * 8/1999 Merrick et al. ..... 84/454
5,977,467 A * 11/1999 Freeland et al. ..... 84/454
6,065,765 A * 5/2000 Chang ..... 280/288.3
6,162,981 A * 12/2000 Newcomer et al. ..... 84/485 R
6,191,348 B1 * 2/2001 Johnson ..... 84/485 R
6,191,350 B1 * 2/2001 Okulov et al. ..... 84/646
6,253,654 B1 * 7/2001 Mercurio ..... 84/267
6,291,755 B1 * 9/2001 Hine et al. ..... 84/454
6,350,942 B1 * 2/2002 Thomson ..... 84/477 R
6,452,081 B1 * 9/2002 Ravagni et al. ..... 84/477 R
6,645,067 B1 * 11/2003 Okita et al. ..... 463/7
6,653,543 B2 * 11/2003 Kulas ..... 84/454

(Continued)

*Primary Examiner*—Lincoln Donovan
*Assistant Examiner*—Christina Russell
(74) *Attorney, Agent, or Firm*—Stites & Harbison PLLC; Richard S. Myers, Jr.

(57) ABSTRACT

An apparatus and method is disclosed for storing, editing, deleting and visually displaying personal information within a stringed musical instrument. A hand-held type computer (34) located in and forming a portion of the envelope or housing of the stringed musical instrument displays personal information to a user from a display screen (44). For example, a user can store, retrieve, edit and delete information such as complete song tablature, contact names, phone numbers, play lists for performance, schedules of shows etc. from within the instrument.

11 Claims, 2 Drawing Sheets

U.S. PATENT DOCUMENTS 6,787,690 B1 * 9/2004 Celi et al. ..... 84/723
6,888,057 B2 * 5/2005 Juszkiewicz et al. ..... 84/645
6,995,310 B1 * 2/2006 Knapp et al. ..... 84/722
2003/0110926 A1 * 6/2003 Sitrick et al. ..... 84/477 R
2004/0098404 A1 * 5/2004 Suzuki et al. ..... 707/102
2005/0252359 A1 * 11/2005 Cook ..... 84/464 A
2006/0000347 A1 * 1/2006 Preece ..... 84/741
2007/0051226 A1 * 3/2007 Diaz ..... 84/477 R

* cited by examiner

STRINGED MUSICAL INSTRUMENT HAVING A BUILT IN HAND-HELD TYPE COMPUTER

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING

Not Applicable

BACKGROUND OF THE INVENTION

1. Field of Invention

This invention relates to stringed musical instruments such as guitars, banjos, violins and mandolins, more specifically, to an apparatus and method for storing and retrieving personal information from within an instrument.

2. Prior Art

In the past, there has been a variety of training aids designed to help students of stringed musical instruments learn particular execution skills such as strumming, fingering, plucking, etc. For example, visual training aids that permit a student to see a display of fingering diagrams and visual/audio training aids that permit a student to see a display of fingering diagrams and to simultaneously hear instructions, notes or chords. While these aids provide training on a wide variety of musical styles and techniques they do not allow the user the capability of manually storing, retrieving, editing and deleting data, such as complete song tablature with lyrics and personal information from within the instrument.

U.S. Pat. No. 4,286,495, granted Sep. 1, 1981 to Roof, discloses a prior art visual training device. The Roof guitar has a first array of lights embedded in its fingerboard and a second array of lights mounted near the sounding hole. Each of the fingerboard lights is located near different finger positions. When energized, the fingerboard act as visual fingering indicators by displaying predetermined left-hand fingering patterns directly on the fingerboard. The lights on the second array indicate the proper strings to be strummed, plucked, picked or otherwise played with the right hand. A manual chord-select switch that is also mounted on the Roof guitar permits the student musician to select predetermined musical chords from a limited set of chords. The manual switches are used to control the light arrays so that visual fingering patterns and right-hand instructions of the selected chord are indicated by the lights. Although this device is made up of an electric guitar and a number of components it is limited to visual training information to the user.

U.S. Pat. No. 4,915,005, granted Apr. 10, 1990 to Shaffer et al., is another visual guitar training device. The Shaffer et al. patent discloses a fingering display that also includes an array of lights embedded in a guitar fingerboard. A number of electrical switches are manually operable by the musician to select a desired note. For each of the notes selected, a light display is activated that shows all the fingering positions for that note. If a scale or chord is selected, then all of the fingering positions for all of the notes of the entire scale or chord are displayed. Although the amount of information available in this device is greater than what is available in the Roof device, like the Roof device, the Shaffer et al. device is limited to visual training information to the user.

U.S. Pat. No. 4,791,848, granted Dec. 20, 1988 to Blum, jr., shows a prior art visual/audio guitar training system. The system is made up of an electric guitar and a number of electronic components. A two track cassette containing audio signals on one track and light-control signals on the other track is played by another component that includes a conventional two-channel cassette player. The audio signals from the player are outputted by one-channel output to a loudspeaker component to play music and/or instructions. Simultaneously, the light control signals are transmitted via the other channel output to the other processing circuit where they are processed and transmitted to the guitar fingerboard. The light-control signals selectively energize the lights to display particular fingering patterns of notes, chords, etc. corresponding to the music and/or instructions being played by the loudspeaker. Additionally, a conventional electric guitar output is transmitted from the guitar pickup to the loudspeaker so that the musical result of the student's playing may also be heard. Although this device comprises a visual display of information along with audio information it is still limited to training information to the user.

U.S. Pat. No. 5,408,914, granted Apr. 25, 1995 to Breitweiser, Jr., et al., is another visual/audio training system. The system is made up of an electric guitar and a number of electronic components. A fingering display (left hand) and a playing display (right hand) are mounted on the fingerboard. A control circuit, mounted on the body, receives input signals from one channel of a stereo for controlling the fingering and playing displays. The fingering and playing displays comprise an array of LEDs and LCDs that indicate the strings to finger, the fingers to use, the strings to play and the direction to play. A freeze control permits the user to freeze a section of the input signals in a buffer for repetitive practice. A tuning circuit permits the user to compare the tone of a string with a stored tone via a tuning display to help tune the instrument. Although the amount of information available in this device is greater than in the Blum device, the amount of information is still limited to training information to the user.

From these prior art examples, it can be seen that while providing instructional information for training on a wide variety of musical styles and techniques these devices are limited to the student musician for training purposes only.

SUMMARY OF THE INVENTION

The general purpose and object of this invention is:

(a) To enable a user to have visual access to personalized information stored within a portable hand-held musical instrument.

(b) To provide reference on music and lyrics from a plurality of songs stored within a portable hand-held musical instrument.

(c) To enable the user to manually store contact names, phone #s, notes, play lists for performance, schedules of shows, etc. in the hand-held musical instrument.

(d) To have the ability to delete unwanted programs and information stored in the hand-held musical instrument.

(e) To enable the user to download new programs and information into the hand-held musical instrument.

(f) To provide the user with the ability to personalize the instrument to accommodate individual needs.

Further objects and advantages of my invention will become apparent from a consideration of the drawings and ensuing description.

DRAWINGS—REFERENCE NUMERALS

Figure 1:
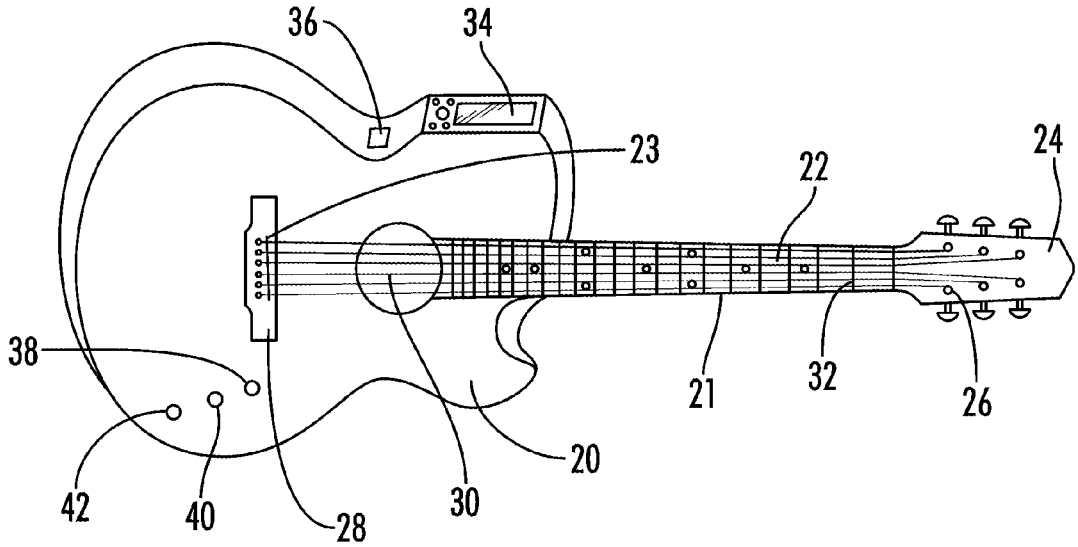
FIG. 1 is a perspective view of a guitar in accordance with this invention illustrating the incorporation of a hand-held type computer into the top portion of a guitar body.

| | | | |
|---|---|---|---|
| 20 | body | 21 | neck |
| 22 | fingerboard | 23 | bridge |
| 24 | head | 26 | nut |
| 28 | tailpiece | 30 | strings |
| 32 | fret | 34 | hand-held type computer |
| 36 | power compartment | 38 | amp/tuning switch |
| 40 | tone control | 42 | volume control |
| 44 | display screen | 46 | scroll button |
| 48 | menu button | 50 | headphone output jack |
| 52 | port hosing | 54 | analog output jack |
| 56 | usb port | 58 | digital equalizer and effects unit |

DETAILED DESCRIPTION OF THE INVENTION—PREFERRED EMBODIMENT

A preferred embodiment would be any stringed musical instrument in accordance with this invention but is illustrated below as an acoustic-electric guitar in accordance with this invention, FIG. 1 (perspective view) and FIG. 3 (perspective view). The acoustic-electric guitar includes a body 20, a neck 21 and six strings 30 that extend from a head 24 to a tailpiece 28. Strings 30 are suspended between a bridge 23 and a nut 26. A conventionally known pickup is mounted inside the body 20. Neck 21 includes a fingerboard 22 with twenty-two frets 32. A hand-held type computer 34 is mounted inside the top portion of the body 20. Batteries are stored in a power compartment 36 for powering the hand-held type computer 34. A port hosing 52 is mounted on the bottom side of the body 20 to enable the conventionally known pickup and the hand-held type computer 34 to be connected to an adjacent source by using an analog cable (not shown) and a Universal Serial Bus Port cable (not shown).

Easily accessible controls are mounted on the lower-front surface of the body 20 for manual operation of an amp/tuning switch 38, a tone control 40, and a volume control 42. The volume control 42 controls the sound generated from the conventionally known pickup. The tone control 40 controls the tone of the sound generated from the conventionally known pickup. The amp/tuning switch 38 selects one of two modes, for example, the first mode where the sound from the conventionally known pickup and the hand-held type computer 34 is outputted to an amplifier (not shown), or mode two where the sound from the conventionally known pickup is outputted to a tuning circuit in the hand-held type computer 34. When the tuning circuit is activated it permits a user to visually compare the tone of a string with a tone stored in the hand-held type computer 34 to help tune the instrument.

Figure 2:
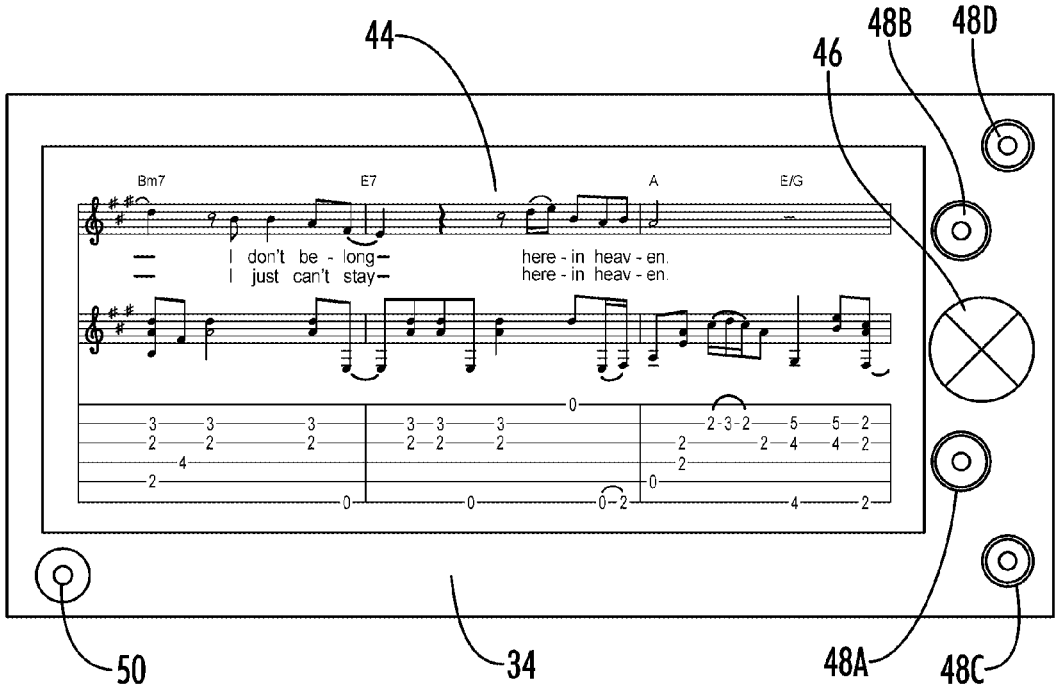
FIG. 2 shows a pictoral view of the hand-held type computer displaying a portion of a song that has been selected for reference.

Referring now to FIG. 2 (pictoral view) which depicts the hand-held type computer 34 of FIG. 1, a display screen 44 visually displays information from stored memory that is held in the hand-held type computer 34 by using a microprocessor. For example, a menu button 48*d* is used to turn on the power to the hand-held type computer 34. After powering up, a main menu of program tabs is displayed in the display screen 44. Then by manually operating a scroll button 46 a user designates a program to be displayed in the display screen 44. At this point the user manually pushes a menu button 48*a* to enter the program. Then by manually operating the scroll button 46 the user cycles through the program directory until reaching the title of information to be acquired. When the title of information wanted is highlighted the user manually pushes the menu button 48*a* again to display the information in the display screen 44. Then the user manually operates the scroll button 46 to cycle through the information displayed in the display screen 44. For example, in FIG. 2 there is a portion of a song in the display screen 44. By using the scroll button 46 the user can cycle through the song until reaching a point desired for reference. Then by using a menu button 48*b* the user can exit the program displayed and return to the main menu in the display screen 44. The user can delete a file that is no longer needed by selecting a delete tab from the program directory. Then by using the scroll button 46 the user designates which file is to be deleted. Then by manually pushing the menu button 48*a* deletes the file selected. The user can then store new files into the hand-held type computer 34 from an adjacent computer by using an USB port (acronym for Universal Serial Bus Port) 56 (not shown). A menu button 48*c* then can be used for turning off the power to the hand-held type computer 34. Also shown in FIG. 2 there is a headphone output jack 50 that outputs the sound from the conventionally known pickup along with any sound files stored in the hand-held computer 34 to a set of headphones (not shown).

Figure 3:
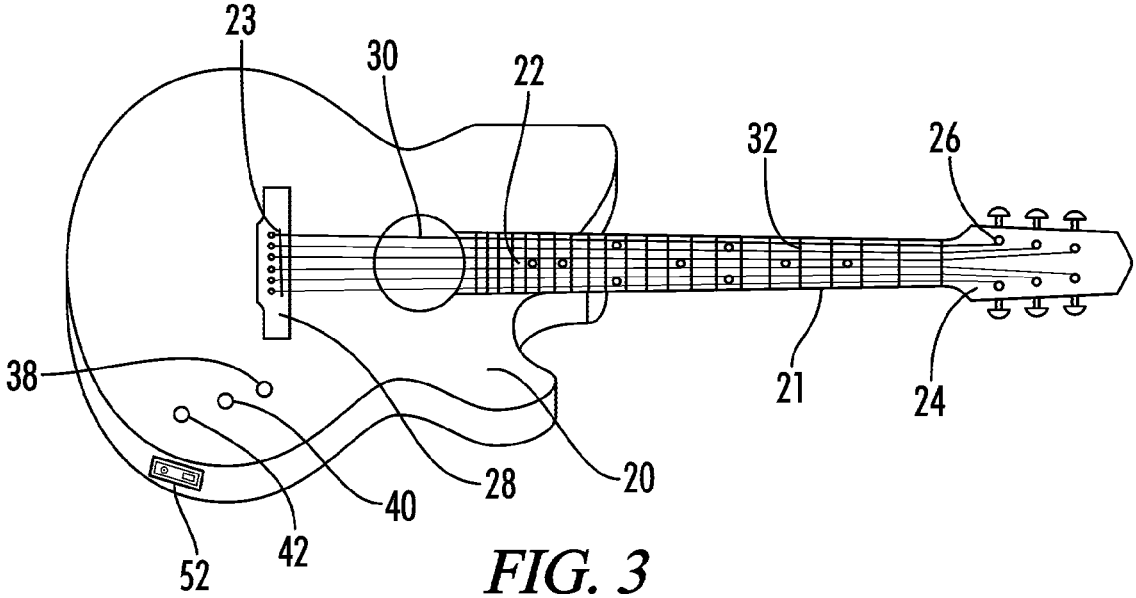
FIG. 3 shows a perspective view of a guitar in accordance with this invention illustrating the attachment of port housing to the bottom side of a guitar body.
Figure 4:
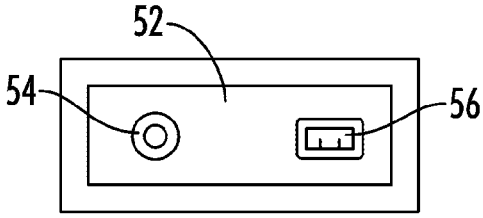
FIG. 4 shows a pictoral view of the port housing illustrating connections for the hand-held type computer and the conventionally known pickup.

Referring to FIG. 4 (pictoral view) which depicts the port hosing 52 of FIG. 3, an analog output jack 54 outputs sound from the conventionally known pickup along with any sounds from the hand-held type computer 34 to an amplifier (not shown) using an analog cable (not shown). The USB port 56 (acronym for Universal Serial Bus port) is used to connect the hand-held type computer 34 to an adjacent computer for uploading and downloading information by using a USB cable (not shown).

Figure 5:
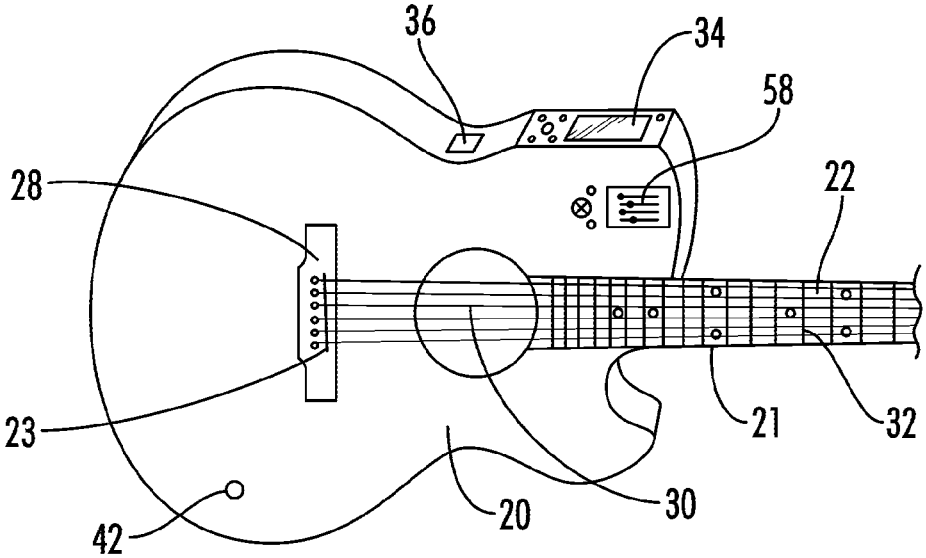
FIG. 5 shows a perspective view of an additional embodiment illustrating the hand-held type computer incorporated with a digital equalizer and effects unit.

FIG. 5 Additional Embodiments

An additional embodiment is shown in FIG. 5 (perspective view). The hand-held type computer 34 is integrated with a digital equalizer and effects unit 58. The digital equalizer and effects unit 58 is used to adjust the tone from the conventionally known pickup (more precisely) and to store digital effects such as delay, chorus, reverb, flange, distortion, gate, compression etc. For example, a user selects the digital equalizer and effects unit 58 from the display screen 44 of the hand-held type computer 34 by the operation mentioned in paragraph [013]. From the program directory the user designates a digital effect or a combination of digital effects to be outputted to an amplifier (not shown). Then by manually pushing the menu button 48*a* the user stores into memory his personalized digital effect. Once a digital effect has been stored the user can adjust the tone of the effect by manually moving slider controls mounted under the hand-held type computer 34 on the front surface of the body 20. The tone control 40 and the amp/tuning switch 38 were eliminated from the guitar body 20. The sound from the conventionally known pickup goes directly to the tuning circuit and the digital equalizer and effects unit 58. From there the sound is outputted to the analog output jack 54 to be connected to an amplifier (not shown).

CONCLUSION, RAMIFICATION, AND SCOPE

Accordingly, the reader will see that the stringed musical instrument of this invention can be used easily and conventionally by all musicians, ether skilled or unskilled in the art of manipulating an instrument.

While my above description contains numerous specificities, these should not be construed as limitations on the scope of the invention but as merely providing illustrations of some of the presently preferred embodiments of this invention. Many other variations are possible. For example, the hand-held type computer could also include a memory strip slot for adding extra memory to the computer. Also the hand-held type computer could be incorporated with a DVD player to enable a user to watch instructional videos. The hand-held type computer could also include touch screen ability and eliminate the need for scroll and menu buttons. The stringed musical instrument could be of many different types, for instance, acoustic guitars, electric guitars, classical guitars, bass guitars, banjos, violins, mandolins, pedal-steel guitars etc. Also the instrument could be made with different body shapes and colors. An additional port hosing could be added for a midi hook up. Also in the additional port housing there could be a cell phone input jack and an analog input jack. The cell phone input jack would be hooked to a speaker phone mounted on the body for sharing musical ideas with friends. The analog input jack would be used to input sounds from a microphone enabling the user to sing along while manipulating the instrument.

Accordingly, the scope of the invention should be determined not by the embodiments illustrated, but by the appended claims and their legal equivalents.

The invention claimed is:

1. A stringed musical instrument, comprising:

a body that generally forms a waist, upper bout and lower bout regions, and comprises a bottom deck, a top deck with a bridge, and a side joining the top and bottom decks;

a neck;

a plurality of strings positioned lengthwise about the neck; and a computer unit held by the body, the computer unit comprising a display held by the side of the upper bout region in a position where the display is viewable by the user when playing the instrument and that provides the user of the instrument with song-related data to assist the user in playing the instrument, and comprising an operating system that allows a user to create, store, recall, and manage music-related and non-music-related data.

2. The stringed musical instrument of claim 1, wherein the body, neck, and strings are components of a guitar.

3. The stringed musical instrument of claim 1, wherein the body, neck, and strings are components of a bass guitar, banjo, mandoline, violin, or pedal-steel guitar.

4. The stringed musical instrument of claim 1, wherein the computer unit is integrated into the body of the instrument.

5. The stringed musical instrument of claim 1, wherein the computer comprises menu-driven software.

6. The stringed musical instrument of claim 5, wherein the menu options can be selected by touching an appropriate position of the display.

7. The stringed musical instrument of claim 1, wherein the computer comprises a digital video disc player.

8. The stringed musical instrument of claim 1, wherein the computer comprises software that stores and visually displays contact names and addresses.

9. The stringed musical instrument of claim 1, wherein the computer comprises an USB port for downloading information from another computer.

10. The stringed musical instrument of claim 1, wherein the song-related data include complete song tablature.

11. A stringed musical instrument, comprising:

a body that generally forms a waist, upper bout and lower bout regions, and comprises a bottom deck, a top deck with a bridge, and a side joining the top and bottom decks;

a neck;

a plurality of strings positioned lengthwise about the neck; and a computer unit held by the body, the computer unit comprising menu-driven software and a display held by the side of the upper bout region in a position where the display is viewable by the user when playing the instrument and that provides the user of the instrument with:

song-related data to assist the user in playing the instrument, and comprising an operating system that allows a user to create, store, recall, and manage music-related and non-music-related data;

visual display capability for contact names and addresses; and visual display of menu options that can be selected by touching an appropriate position of the display.

* * * * *